US005910397A

United States Patent [19]

Feumi-Jantou et al.

[11] Patent Number: 5,910,397

[45] Date of Patent: Jun. 8, 1999

[54] METHOD OF PROCESSING A PHOTOGRAPHIC PRODUCT

[75] Inventors: Christiane B. Feumi-Jantou, Chalon Sur Saone, France; Zoe Orr, Watford; Jeffrey K. Green, Harrow, both of United Kingdom

[73] Assignee: Eastman Kodak Company, Rochester, N.Y.

[21] Appl. No.: 09/062,087

[22] Filed: Apr. 17, 1998

[30] Foreign Application Priority Data

Apr. 18, 1997 [FR] France ..... 97 05096

[51] Int. Cl.[6] ..... G03C 5/39

[52] U.S. Cl. ..... 430/428; 430/429; 430/943

[58] Field of Search ..... 430/428, 429, 430/943

[56] References Cited

FOREIGN PATENT DOCUMENTS

| | | |
|---|---|---|
| 0 474 461 A1 | 10/1990 | European Pat. Off. . |
| 63 044 654 | 8/1986 | Japan . |
| 63-044654 | 2/1988 | Japan . |

OTHER PUBLICATIONS

Research Dis. vol. 131, No. 42, Mar. 1975, Havant GB p. 46 XP002038779, JT O'Connor et al. "Use of ionic surfactants in photographic processing solutions" p. 46.

*Primary Examiner*—Hoa Van Le
*Attorney, Agent, or Firm*—J. Lanny Tucker

[57] ABSTRACT

The present invention concerns a novel method of processing a photographic product. In particular, method includes processing a photographic product that comprises a step of surface washing with a solution comprising an oxidizing agent, and a wetting agent. This processing method affords effective washing with a reduced quantity of water.

8 Claims, 2 Drawing Sheets

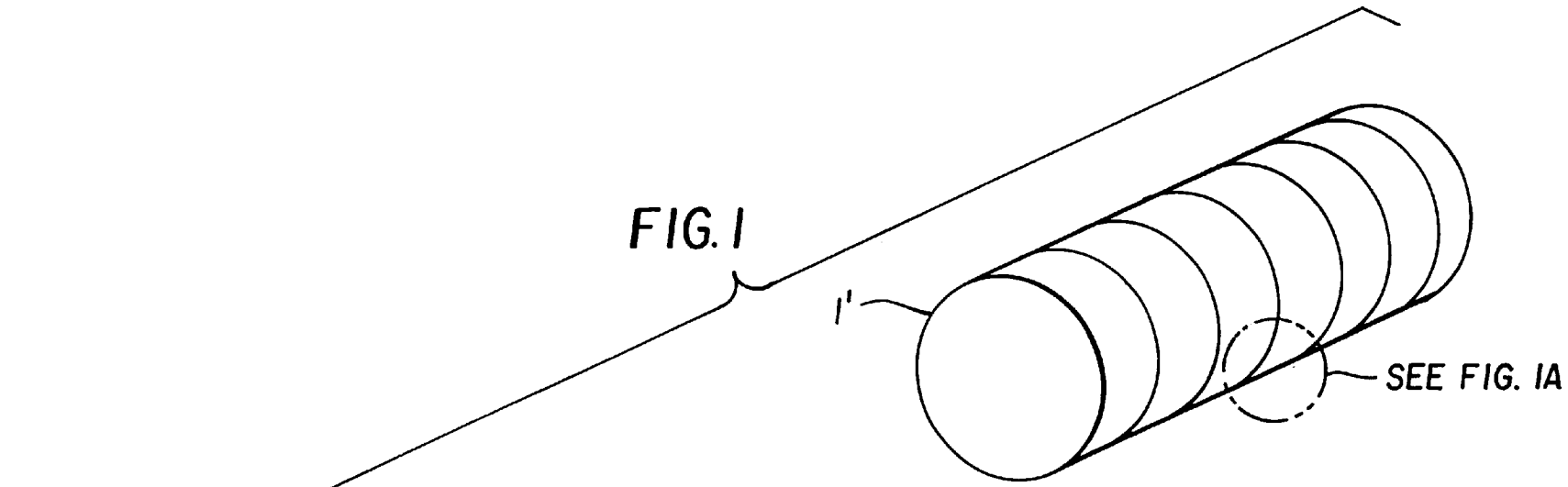
FIG. I
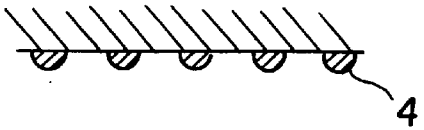
FIG. IA
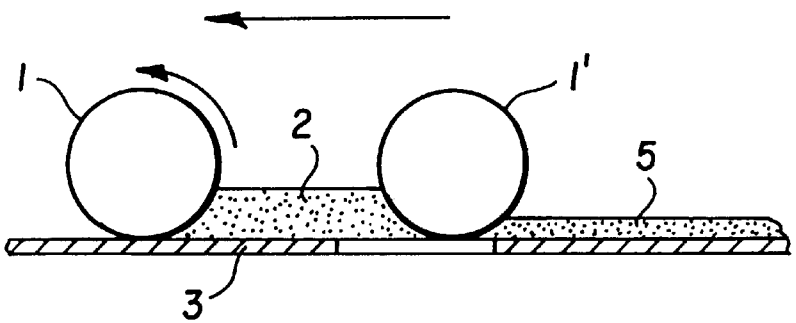

METHOD OF PROCESSING A PHOTOGRAPHIC PRODUCT

FIELD OF THE INVENTION

The present invention concerns a novel method of processing a photographic product. In particular, the invention concerns a method of processing a photographic product using a step of washing by surface application.

The invention also including a washing solution for use in the method. Conventionally, the development of a black-and-white photographic product comprises a development step, a fixing step and a washing step. The processing of color photographic products comprises a color development step, a bleaching step, a fixing step and a washing step. The fixing step eliminates the silver ions present in the photographic product by solubilization of these ions in the fixing bath. Conventionally, the fixing bath contains thiosulfate that, by reacting with the silver ions, forms a silver complex of thiosulfate which is soluble in water. This silver complex of thiosulfate is eliminated from the photographic product during the washing step. The washing of the photographic product is effected by diffusion through the layers containing gelatin. Through contact of the photographic product with pure water, the silver complex of thiosulfate migrates from the photographic layer to the pure water.

The greater the quantity of pure water in contact with the product, the more effective and rapid the washing, the difference in concentrations being thus always at its maximum. Series of tanks or tubes disposed in cascade ensure highly effective washing.

Conventionally, the washing step is implemented in a tank in which water is circulated in order to maintain in the tank an effective stirring that facilitates the migration of the complex from the photographic layer to the pure water and effectively solubilizes the silver complex of thiosulfate contained in the photographic product. The washing time depends on the thickness of the layer and on the way in which it is carried out. Depending on the photographic product being processed, this time varies between 15 minutes and 2 hours. For a washing to be effective, each time at least two liters of water per $m^2$is required, changing the washing bath six times.

When the silver complex of thiosulfate is not completely eliminated from the photographic product, it decomposes over time into a yellow-brown silver sulfide and sulfuric acid. These compounds will then slowly degrade the silver image. Perfect preservation of the silver image is ensured only by complete washing.

Effective washing of the photographic product therefore requires the use of large quantities of water, and the recycling or destruction of this water loaded with a silver complex gives rise to many problems, in particular with regard to environmental protection. This problem is all the greater since the standards for discharging chemical solutions are becoming more and more strict. It is therefore desirable to develop a photographic processing system that uses a reduced quantity of water.

It is known that thiosulfate chelated in a photosensitive silver halide layer can be eliminated by processing in a tank with oxygenated water, in an alkaline medium. In this case, the washing bath contains oxygenated water and ammonia. This bath is particularly unstable. In addition, it presents numerous drawbacks such as a change in color of the image, a slight yellowing, a softening of the gelatin and a precipitation of the silver in the washing bath.

There exist photographic processing systems that consist of putting a photographic product in contact with a support impregnated with an active substance. For example, FR 2,003,178 and FR 2,414,743 describe a method of developing a photographic product with an incorporated developing agent that consists of putting this product in contact with a support covered with gelatin impregnated with a basic activator. This system gives a silver image with a minimum volume of developer. In these two patents, the washing is effected in a conventional fashion in a tank.

SUMMARY OF THE INVENTION

One of the aims of the present invention is to provide a method of processing a photographic product in which the washing step is implemented effectively with a reduced quantity of water.

A second aim of the invention is to provide a method that can be implemented without a complex water supply installation, and which is simple to use.

Another aim of the invention is to provide an effective washing step that does not have the drawbacks of the prior art.

These aims, as well as others, are achieved with the present invention, which relates to a method of processing a photographic product comprising the steps of:

a) developing the photographic product, b) fixing the photographic product with a solution containing thiosulfate, and c) washing the photographic product, wherein the washing step consists of applying, to the photographic product, a layer of a homogeneous aqueous washing solution comprising an oxidizing agent capable of oxidizing the thiosulfate ions into sulphate ions and a photographically inert wetting agent.

The present invention also concerns a processing solution for washing a photographic product, comprising in homogeneous aqueous solution, an oxidizing agent capable of oxidizing thiosulfates into sulphate ions and a photographically inert wetting agent.

BRIEF DESCRIPTION OF THE DRAWINGS

FIGS. 1 and 2 are schematic illustrations of devices useful in the practice of this invention to make surface application of the washing solution.

Figure 2:
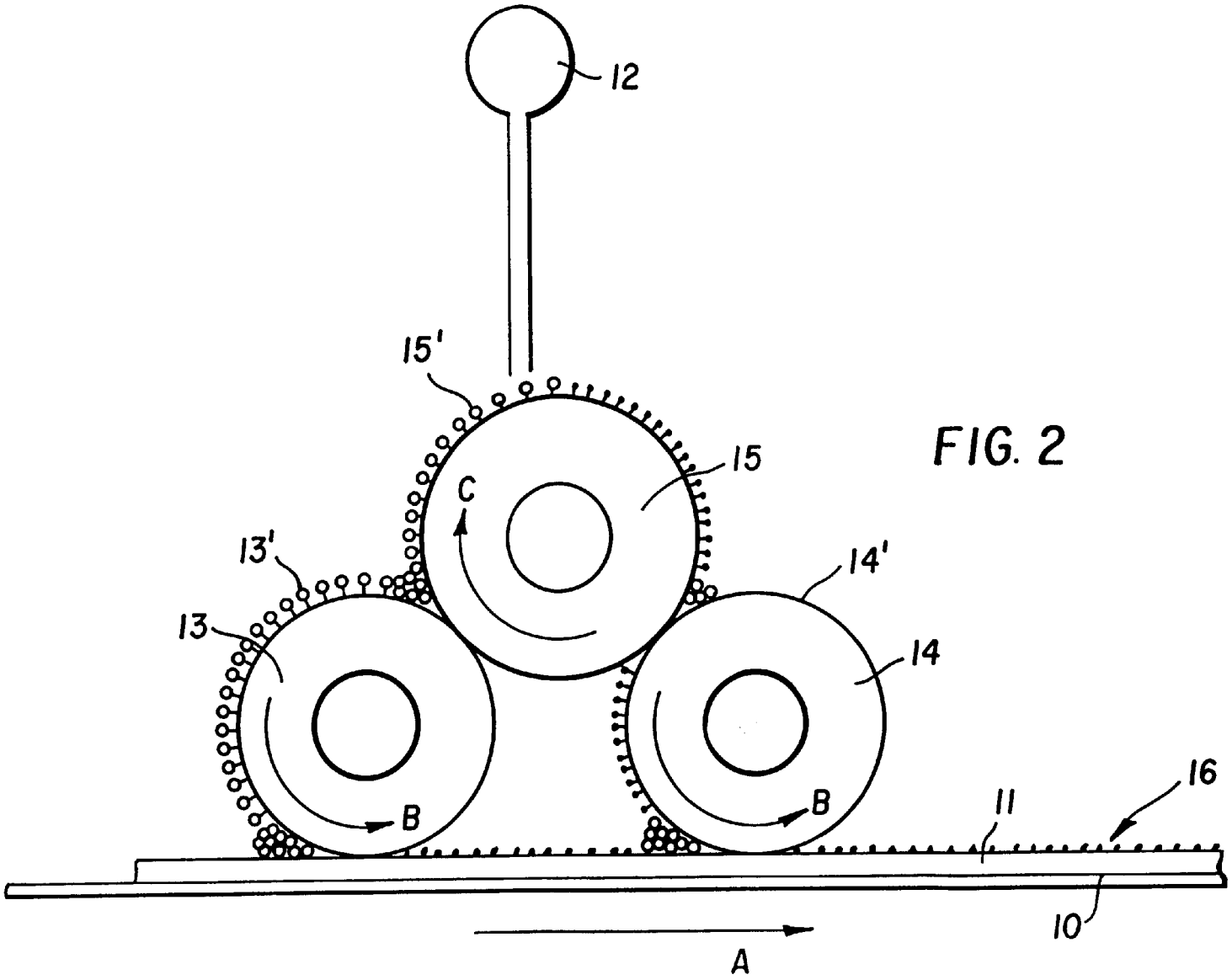

In the scope of the present invention, the processing method comprises a washing step of a photographic product by surface application, that is to say the exposed photographic product is not immersed in a tank filled with pure water until the washing is terminated but the face of the photographic product opposite to the support is covered with a layer of washing solution according to the present invention.

The coating of the washing solution in a layer can be effected by any known means which makes it possible to apply an aqueous solution uniformly on a flat support in order to form a layer. This coating can be effected manually or automatically. For example, such a layer can be formed by spraying, immersion, atomization or coating.

Surprisingly, the method of the invention makes it possible to wash photographic products effectively with a reduced volume of water and without stirring.

According to the invention, photographic products can be washed very satisfactorily with a volume of washing solution of between 20 and 200 $ml/m^2$. According to one particular embodiment, the volume of washing solution is between 20 and 100 $ml/m^2$ and preferably between 20 and 50 ml/m$^2$, depending on the quantity of silver ions to be eliminated from the photographic product.

This method also has the advantage of using a single-usage washing solution for each washing, which prevents the contamination of the washed photographic products and the precipitation of silver into the washing bath.

According to one particular embodiment, the method of the invention comprises an additional step that consists of eliminating the excess of fixing bath before the washing. This step can be implemented by means of a squeegee, a centrifuge, an absorbent material etc.

According to a particular embodiment, the washing solution is applied by means of the device described in FIG. 1, which comprises two rollers (1, 1') connected together and forming a reservoir containing the washing solution to be spread (2), the whole being placed on the surface of the film (3) to be washed. The leading roller (1) is covered with a flexible rubber, and the rear roller (1') is a roller with a ribbed surface (4) which makes it possible to control the spreading of the layer of washing solution (5). The device is equipped with means for automatically moving the device over the film, which makes it possible to deposit a thin uniform layer of washing solution on the film (not visible in the figure).

According to another embodiment, the washing solution is applied by means of the device described in patent application GB 9519709.1 filed on Sep. 27, 1995 in the name of Kodak Ltd. This device, described in FIG. 2, comprises a surface (10) which supports the photographic product to be washed (11), a means of conveying the photographic product, which does not appear in the figure, a reservoir (12) which delivers a given quantity of washing solution, a means for applying the washing solution which comprises at least two lower rollers (13, 14) in contact with the photographic product to be washed, and an upper roller (15) situated above each of the two lower rollers (13, 14), the upper roller (15) being in contact with the lower rollers (13, 14). The washing solution is deposited on the surface of the roller (15') and then flows over the surface of the lower rollers (13', 14'). When the photographic product is moved in the direction of the arrow (A), the lower rollers (13, 14) are rotated as indicated by the arrows (B, C), which causes the upper roller (15) to rotate. This rotation deposits a thin layer (16) of washing solution on the film to be developed, as shown in FIG. 2.

These two embodiments are described by way of example. It is possible to form this layer of washing solution by any known coating technique.

In the context of the invention, the washing solution contains an agent capable of oxidizing the thiosulfate ions into sulphate ions. In fact, it is important to obtain an oxidation product that is colorless and soluble, and this is why it is important to obtain the sulfate ions as the final oxidation product.

According to the present invention, the oxidizing agent capable of oxidizing thiosulfate is chosen from amongst hydrogen peroxide, perborates and persulfates. Preferably, oxidizing agents with a low molecular weight are used in order to assist the diffusion of this agent in the layer containing gelatin. The quantity of this agent in the washing solution can vary over a wide range; for example, it can vary between 0.5 and 30% by weight of solution. However, this quantity is preferably less than 5% by weight of the washing solution. This is because greater quantities, although effective for the elimination of the thiosulfates, can cause bleaching of the silver image.

In the context of the invention, the washing solution comprises at least one photographically inert wetting agent. Photographically inert wetting agent means a surfactant that facilitates the spreading of the washing solution all over the film and which promotes the chemical exchanges between the washing solution and the photographic product to be processed without causing any photographic degradation, for example a degradation of the gelatin, the appearance of fog etc. This wetting agent facilitates the diffusion of the chemical species to be eliminated from the photographic layer to the layer of washing solution. This agent gives a uniform layer of washing solution on the photographic product to be washed. It must form a homogeneous solution with the other compounds present in the solution. It must be stable over time in a highly oxidizing environment. This is because the washing solution must be able to be preserved without losing its washing or spreading properties.

Provided that they meet the above criteria, these wetting agents can be anionic, cationic, non-ionic or amphoteric surfactants, alone or in a mixture.

These surfactants are for example ZONYL FSN®, ALKANOL XC® manufactured by Dupont, LODYNE S-100® manufactured by Ciba-Geigy or OLIN 10G® manufactured by Olin Mathieson.

According to one embodiment of the invention, the quantity of wetting agent is between 0.1 and 3% by volume of washing solution.

In addition to the development, fixing and washing steps, the method of the invention may comprise if necessary a bleaching step and/or a reversal step. The development step can be a development step in a black-and-white developer for black-and-white photographic products or a development step in a color developer for color photographic products.

The black-and-white developer is a conventional developer that contains a reducing agent of silver halides such as aminophenols, polyhydroxybenzenes, for example hydroquinone or hydroquinone derivatives, 3-pyrazolidinones, pyrogallol, pyrocathecol, ascorbic acid etc.

Color developers are in general compounds that, in their oxidized form, react with a dye coupler to form a color image, the coupler being present either in the developer or in the photographic product. These compounds are conventionally paraphenylenediamines, for example diethyl-p-phenylenediamine, ethylhydroxyethyl-p-phenylenediamine, etc.

Any type of photographic product can be processed with the method of the invention. For example, it is possible to process negative-working photographic products, positive-working photographic products, black-and-white photographic products such as radiographic products, photographic products for graphic art, color photographic products or reversal photographic products.

According to a particular embodiment, the photographic product is a photographic product with incorporated developing agents that can be developed by contact with a basic activator. This activator can be applied to the photographic product in a layer in accordance with the application method described previously for the washing solution. In this way the volume of the processing baths and effluents is reduced. Such a development method was described in the application FR 9605192 filed on Apr. 19, 1996.

Photographic products conventionally comprise a support covered on at least one of its faces with a layer of silver halide emulsion. Such photographic products are described in *Research Disclosure,* September 1994, 368, No 36544 (hereinafter referred to as *Research Disclosure*).

The silver halide emulsion consists of silver halide grains in a hydrophilic binder, for example gelatin. The different methods of preparing such emulsions were described in *Research Disclosure,* Section I-C. The gelatin can be replaced partly by other synthetic or natural hydrophilic colloids such as albumin, casein, zein, a polyvinyl alcohol or cellulose derivatives, for example carboxymethylcellulose. Such colloids are described in Section II of *Research Disclosure.* The silver halide grains can have different morphologies (see Section 1-B of *Research Disclosure*).

Research Disclosure Section 1-A describes the silver halide compositions of these grains. The silver halide grains can consist of chloride, bromide, chlorobromide, bromochloride, chloroiodide, bromoiodide or bromochloroiodide. According to a preferred embodiment, the emulsion contains a majority of silver chloride.

The silver halide grains can be chemically sensitized as described in *Research Disclosure* Section IV.

The silver halide grains can be spectrally sensitized as described in *Research Disclosure* Section V.

In addition to the above-mentioned compounds, the photographic product can contain other photographically useful compounds, for example coating aids, stabilizers, plasticizers, anti-fog agents, tanning agents, anti-static agents, matting agents etc. Examples of such compounds are described in *Research Disclosure* Sections VI, VII, VIII and X.

The supports that can be used in photography are described in Section XV of *Research Disclosure.* These supports are in general polymeric supports such as cellulosic, polystyrene or polyvinyl polymers, polyamides, polyethylenes, polyesters or paper or metallic supports.

The photographic products can contain other layers, for example a protective top layer, intermediate layers, an anti-halation layer, an anti-static layer etc. These different layers and their arrangements are described in Section XI of *Research Disclosure.*

The invention is illustrated in more detail in the following examples:

EXAMPLES

Example 1

A photographic product was used which comprised an ESTAR® ethylene polyterephthalate support covered with an underlayer of gelatin (1.8 g/m$^2$) containing a developing agent (tert-butylhydroquinone (TBHQ), 1.7 g/m ), a co-developer (4-methyl-4-hydroxymethylphenidone, 0.1 g/m$^2$), a hardening agent (bisvinylmethylsulfone, 3.5% by weight with respect to total dry gelatin). This underlayer was covered with a layer of silver halide emulsion, itself covered with a top protective layer of gelatin (0.8 g/m$^2$).

The silver halide emulsion comprised cubic grains (0.2 $\mu$m side) of silver chlorobromide (70 mol. % of chloride) dopped with rhodium. The grains were chemically sensitized with sulfur ($2.98\times10^{18}$ atoms of sulfur/mol Ag) and with gold ($3.50\times10^{18}$ atoms of gold/mol Ag). They were blue spectrally sensitized with a spectral sensitizer of formula (I) (maximum absorption 490 nm).

(I)

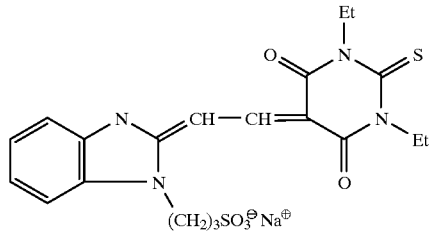

The silver coverage of the layer of emulsion was 3.2 g/m$^2$ and the gelatin coverage 2 g/m$^2$.

The photographic product described above was then exposed through a sensitometric wedge with 18 steps (increments of 0.1) with a xenon flash exposure meter for 2 microseconds through a colored filter approximately simulating the emission of a blue CRT (p11 type).

After exposure, the film described above was processed with the RPX-OMAT® process, which comprises a black-and-white developer with hydroquinone as developing agent, a fixing agent and a washing solution.

| Composition of the fixing bath | |
|---|---|
| Ammonium thiosulfate | 142 |
| Sodium sulfate | 15.28 |
| Boric acid | 6.07 |
| Tartaric acid | 1.5 |
| Aluminum sulphate | 7.04 |
| pH = 4.10 | |

On leaving the fixing bath, the film was wrung out with a squeegee.

The film was then washed by applying 25 ml/m$^2$ of the washing solutions described below to the film with the device in FIG. 1.

| | |
|---|---|
| Solution A | $H_2O$<br>OLIN 10G ® wetting agent (0.6% by weight)<br>pH = 6 |
| Solution B | $H_2O$<br>OLIN 10G ® wetting agent (0.6% by weight)<br>Hydrogen peroxide (2% by volume)<br>pH = 6 |
| Solution C | $H_2O$<br>OLIN 10G ® wetting agent (0.6% by weight)<br>Hydrogen peroxide (5% by volume)<br>pH = 6 |

The residual quantity of thiosulfate was then measured on each film (determination by the methylene blue method in accordance with ISO 417: 1993 (E)).

The results are set out in Table 1 below.

TABLE 1

| | Quantity of residual thiosulfate (mg/m$^2$) |
|---|---|
| Washing solution A | 137 |
| Washing solution B | 62 |
| Washing solution C | 30 |
| Without washing | 971 |

These results show that the addition of hydrogen peroxide to a washing solution by surface application improves the elimination of the thiosulfate contained in the photographic product. In addition, the presence of the wetting agent is necessary to obtain a good surface application.

Example 2

After exposure, the photographic film described previously was developed according to the method of Example 1, except that the washing was implemented in the device in FIG. 2.

The following results were obtained:

TABLE 2

| | Quantity of residual thiosulfate ($mg/m^2$) |
|---|---|
| Washing solution A | 129 |
| Washing solution C | 7.5 |
| Without washing | ≅1000 |
| Washing in tank | ≅10 |

This example shows that washing by surface application can be as effective as washing in a tank with a very much reduced volume of solution.

Example 3

After exposure, the above photographic product was developed according to the method and device of Example 1 with the following washing solutions:

| | |
|---|---|
| Solution D | $H_2O$<br>Perborate (1% by volume)<br>OLIN 10G ® wetting agent (0.6% by weight)<br>pH = 6 |
| Solution E | $H_2O$<br>Persulfate (5% by volume)<br>OLIN 10G ® wetting agent (0.6% by weight)<br>pH = 6 |

The results are set out in Table 3 below.

TABLE 3

| | Quantity of residual thiosulfate ($mg/m^2$) |
|---|---|
| Solution D | 35 |
| Solution E | 22 |
| Without washing | ≅1000 |

These examples illustrate the efficiency of persulfates and perborates for surface-application washing.

Example 4

After exposure, the photographic products described previously were developed in accordance with the method of Example 1 with a washing solution (F) freshly prepared and 4 hours after its preparation, and with a solution whose pH was modified (F'), freshly prepared and 4 hours after its preparation.

| | |
|---|---|
| Solution F | $H_2O$<br>Hydrogen peroxide (1% by vol)<br>OLIN 10G ® wetting agent (0.6% by weight)<br>pH = 6 |

-continued

| | |
|---|---|
| Solution F' | $H_2O$<br>Hydrogen peroxide (1% by vol)<br>OLIN 10G ® wetting agent (0.6% by weight)<br>pH = 9.5 |

The results are set out in Table 4 below.

TABLE 4

| | | Residual thiosulfate ($mg/m^2$) |
|---|---|---|
| Washing solution F | T = 0 | 38 |
| | T = 4 hrs. | 50 |
| Washing solution F' | T = 0 | 46 |
| | T = 4 hrs. | 45 |

These examples show that the washing solution of the invention is stable over time. In addition, the pH does not effect the efficacy of the washing.

Example 5

After exposure, the photographic product described above was developed according to the method of Example 1 with the following washing solution:

| | |
|---|---|
| Solution G | $H_2O$<br>Hydrogen peroxide (3% by vol)<br>Alkanol XC ® wetting agent (0.6% by weight)<br>pH = 6 |

Tests were performed with the solution freshly prepared and 4 hours after its preparation.

The results are set out in Table 5 below.

TABLE 5

| | | Residual quantity of thiosulfate ($mg/m^2$) |
|---|---|---|
| Solution G | T = 0 | 37 |
| | T = 4 hrs. | 40 |

The invention has been described in detail with particular reference to certain preferred embodiments thereof, but it will be understood that variations and modifications can be effected within the spirit and scope of the invention.

We claim:

1. A method of processing a photographic product comprising the steps of:

a) developing the photographic product, b) fixing the photographic product with a solution containing thiosulfate, and c) washing the photographic product, wherein the washing step consists of applying, to the photographic product, a layer of a homogeneous aqueous washing solution comprising an oxidizing agent capable of oxidizing the thiosulfate ions into sulphate ions and a photographically inert wetting agent.

2. The processing method of claim 1 further comprising an additional step of eliminating the excess of fixing solution before said washing step.

3. The processing method of claim 1 wherein said oxidizing agent capable of oxidizing said thiosulfate ions into sulphate ions is a peroxide, perborate or persulfate.

4. The processing method of claim 1 wherein said washing solution comprises said of oxidizing agent at between 0.5 and 30% by weight of said washing solution.

5. The processing method of claim 4 wherein said oxidizing agent is present is said washing solution at less than 5% by weight of said washing solution.

6. The processing method of claim 1 in which said washing step comprises applying a layer of washing solution in a quantity of between 20 and 100 ml/$m^2$ of photographic product to be processed.

7. The processing method of claim 1 for the development of a black-and-white photographic product having a silver coverage of between 1 and 4 g/$m^2$.

8. The processing method of claim 1 wherein said photographic product is a photographic product comprising an incorporated developing agent.

* * * * *